US006945428B2

(12) United States Patent
Shimizu et al.

(10) Patent No.: US 6,945,428 B2
(45) Date of Patent: Sep. 20, 2005

(54) LIQUID CONTAINER AND LIQUID CONTAINER MANUFACTURING METHOD

(75) Inventors: Eiichiro Shimizu, Hong Kong (HK); Masanori Takenouchi, Yokohama (JP); Hajime Yamamoto, Fuchu (JP); Hiroshi Koshikawa, Yokohama (JP); Fumitaka Goto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 59 days.

(21) Appl. No.: 10/342,284

(22) Filed: Jan. 15, 2003

(65) Prior Publication Data

US 2003/0218021 A1 Nov. 27, 2003

(30) Foreign Application Priority Data

Jan. 16, 2002 (JP) ..... 2002-007363

(51) Int. Cl.[7] ..... B65D 35/56; B67D 5/42

(52) U.S. Cl. ..... 222/105; 222/107; 222/206; 222/215; 222/386.5; 222/321.1

(58) Field of Search ..... 222/105, 107, 222/206, 215, 320–321.9, 383.1, 378, 386.5, 130, 131, 478; 220/723

(56) References Cited

U.S. PATENT DOCUMENTS 5,242,085 A * 9/1993 Richter et al. ..... 222/105
6,266,943 B1 * 7/2001 Nomoto et al. ..... 53/410
6,305,794 B1 10/2001 Sasaki et al. ..... 347/86
2001/0040173 A1 * 11/2001 Yamamoto et al. ..... 222/106
2002/0040908 A1 4/2002 Hattori et al. ..... 220/678

FOREIGN PATENT DOCUMENTS

JP 4-339759 11/1992
JP 10-151762 6/1998
WO WO 94/27888 * 12/1994 ..... B65D/83/00

* cited by examiner

*Primary Examiner*—Michael Mar
*Assistant Examiner*—Patrick Buechner
(74) *Attorney, Agent, or Firm*—Fitzpatrick, Cella, Harper & Scinto

(57) ABSTRACT

A container includes an inner layer portion for liquid, an outer layer having an inner shape substantially equivalent to an outer shape of the inner layer, with the outer layer having an air vent communicating from between the two layers and the ambient, and a dispensing portion. When liquid is dispensed, the inner layer peels off the outer layer. The inner layer and the outer layer are bonded, in a first region, to each other with a force such that the inner layer is peelable from the outer layer by change of pressure, and the inner layer and the outer layer are bonded, in a second region, to each other with a force which is larger than that in the first region, by which the inner layer peels off the outer layer in the second region after the inner layer peels off the outer layer in the first region.

5 Claims, 7 Drawing Sheets

LIQUID CONTAINER AND LIQUID CONTAINER MANUFACTURING METHOD

FIELD OF THE INVENTION AND RELATED ART

The present invention relates to a multilayer container such as a bottle, molded of a thermosetting resin; more specifically, a container designed so that the internal and external layers of the container separate from each other to allow the liquid in the container to be efficiently discharged from the container.

A container for storing liquid foods (viscous foods such as mayonnaise and ketchup), liquid detergent, liquid drugs, etc., like the multilayer bottle disclosed in Japanese Laid-open Patent Application 4-339759 is known. According to this application, the internal and external layers of the container are able to separate from each other. One of the technical objects of this application is to prevent the decrease in the internal pressure of the cylindrical bottle from altering the external shape of the bottle. Further, this application discloses a structural arrangement, according to which the cylindrical bottle comprises a minimum of two layers, external and internal layers, which are allowed to separate from each other while remaining adhered to each other at one or more predetermined areas. It also discloses a method for forming such a cylindrical bottle, according to which one or more portions of the parison for forming the external and internal layers are provided with predetermined areas across which the two layers become connected. More specifically, the two layers are connected at the mouth and bottom of the bottle. The application further claims that it is possible to deform the internal layer into a predetermined shape by determining the areas at which the external and internal layers are adhered to each other, and also that the contents of the bottle can be efficiently removed from the bottle through its mouth.

A multilayer container such as the one described above has also been used as an ink container in the field of ink jet recording, in which an ink container must be able to maintain a proper amount of negative pressure at its liquid delivery mouth while the liquid in the container is drawn out of it. Japanese Laid-open Patent Application 10-151762 discloses such an multilayer ink container approximately in the form of a polygonal pillar. For the purpose of keeping constant the negative pressure generated at the liquid outlet, this type of multilayer ink container is known to be provided with one or more deformation controlling members such as ribs, which are arrange in a predetermined manner across the entire surface, exclusive of the peripheries thereof, of the largest section of the internal layer, which is virtually the same in shape as the inward surface of the corresponding section of the external layer. According to the above described publication, as the liquid is drawn out of the container, only the peripheral portions of the surface of the largest section of the internal layer deforms while the portions of the internal layer provided with the deformation controlling members move like rigid portions. Therefore, the negative pressure generated as the liquid is drawn out of the liquid container remains stable, rendering the liquid container superior in utility.

SUMMARY OF THE INVENTION

However, in the case of the liquid container disclosed in Japanese Laid-open Patent Application 4-339759, the liquid storage portion of the container is cylindrical Therefore, the deformation might start from any point of the cylindrical portion of the container, where the internal and external layers are adhered to each other, making it difficult to predict the shape into which the internal layer deforms. Further, there is the possibility that as the liquid is consumed, a given portion of the internal layer will came into contact with another part of the internal layer. Such a contact between two portions of the internal layer sometimes makes it difficult for the internal layer to further deform. It is possible to increase the areas of the liquid container walls across which the internal and external layers are adhered to each other. However, such a measure reduces the areas of the liquid container walls across which the internal layer is separable from the external layer. In either case, there is the possibility that it will become impossible to remove the contents from the liquid container.

In comparison, in the case of the structural arrangement disclosed in Japanese Laid-open Patent Application 10-151762, there is no possibility that it will becomes impossible to take the contents out of the liquid container. In this case, however, the deformation regulating members must be adjusted in number, configuration, etc., according to the resin used as the material for the internal layer and the thickness of the internal layer. Further, this structural arrangement is not compatible with a cylindrical liquid container or the like; in other words, it is limited in latitude in terms of liquid container design.

The present invention, which relates to a multilayer liquid container, the internal layer of which is separable from the external layer thereof, is made to solve the above described problems in the prior art. Its primary object is to make it possible to control the order in which the various deformable portions of the internal layer deform, regardless of the shape or thickness of the internal wall, and material of which the liquid container is made.

The second object of the present invention is to provide a simple method for manufacturing a liquid container in accordance with the primary object of the present invention.

A liquid container in accordance with the present invention made to solve the above described problems, comprises: an internal layer making up the liquid storage portion for internally holding liquid; an external layer, which is virtually the same in size as the outward surface of the internal layer, and is provided with air vent for establishing passage between the ambience and the space between the internal layer and the inward surface of the external layer; and a liquid outlet for delivering outward the liquid within the liquid storage portion, wherein as liquid is drawn out through the liquid outlet, the internal layer separates from the external layer. The liquid container further comprises a first region in which the internal layer is adhered to the external layer in such a manner that the former can be separated from the latter by external force; and a second region in which the internal layer is also adhered to the externa layer in such a manner that the former can be separated from the latter by external force, wherein the external force necessary to separate the internal layer from the external layer in the second region is greater than that in the first region, and wherein as the liquid is drawn out of the liquid storage portion, the internal layer in the second region separates from the external layer after the internal layer in the first region entirely separates from the external layer.

According to the present invention, more latitude is afforded in presetting the points at which the internal layer deforms as the contents are drawn out of the liquid container. Therefore, it is possible to deform various portions of the internal layer in the ideal order, regardless of the container shape, container wall thickness, resin as container material, etc., making it possible to accomplish the first object of the present invention.

A method for manufacturing a liquid container, in accordance with the present invention made to solve the above described problems, comprises: an internal layer making up the liquid storage portion for internally holding liquid; an external layer, which is virtually the same in size as the outward surface of the internal layer, and is provided with an air vent for establishing passage between the ambience and the space between the internal layer and the inward surface of the external layer; and a liquid outlet for delivering outward the liquid within the liquid storage portion, wherein as liquid is drawn out through the liquid outlet, the internal layer separates from the external layer. The method comprises a process in which a liquid container comprising the internal layer, external layer, and liquid outlet is prepared; a process in which the contents of the container are drawn out to form a space between the internal and external layers; and a process in which adhesives varying in strength are applied on the surface of the internal layer through the air vent.

Another method for manufacturing a liquid container, in accordance with the present invention made to solve the above described problems, comprises: an internal layer making up the liquid storage portion for internally holding liquid; an external layer, which is virtually the same in size as the outward surface of the internal layer, and is provided with an air vent for establishing passage between the ambience and the space between the internal layer and the inward surface of the external layer; and a liquid outlet for delivering outward the liquid within the liquid storage portion, wherein as liquid is drawn out through the liquid outlet, the internal layer separates from the external layer. The method comprises a first process in which a mold, the internal contour of which is equivalent to the external contour of the liquid container, and a parison, which is made up of a resin as the material for the internal layer and another resin as the material for the external resin, are prepared; a second process in which the heated parison is held sandwiched by the mold, and air is blown into the parison to force the parison to conform to the shape of the mold; a third process in which the parison is cooled within the mold, wherein during the second or third process, predetermined areas of the mold, with which the parison comes into contact, are made different in temperature from the other areas of the mold.

As described above, according to one of the characteristic aspects of the present invention, in order to make the adhesive strength between the internal and external layers of a liquid container, across predetermined portions of the liquid container, across predetermined portions of the liquid container, different from that in the other portions of the liquid container, a space is provided between the internal and external layers of a liquid container, and a plurality of adhesives varying in strength are applied to the surface of the internal layer through an air vent. According to another characteristic aspect of the present invention, in order to make the adhesive between the internal and external layers of a liquid container, across predetermined portions of the liquid container, different in strength from that in the other portions of the liquid container, a parison is held sandwiched by a mold, and the portions of the mold corresponding to the predetermined portions of the liquid container are made different in temperature from the other portions of the mold. Therefore it is possible to accomplish the second object.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention will be described in detail with reference to the appended drawings. In the sectional drawings related to each embodiment, if an area is covered with dot-like short lines, it means that the area is filled with liquid.

(Embodiment 1)

Figure 1:
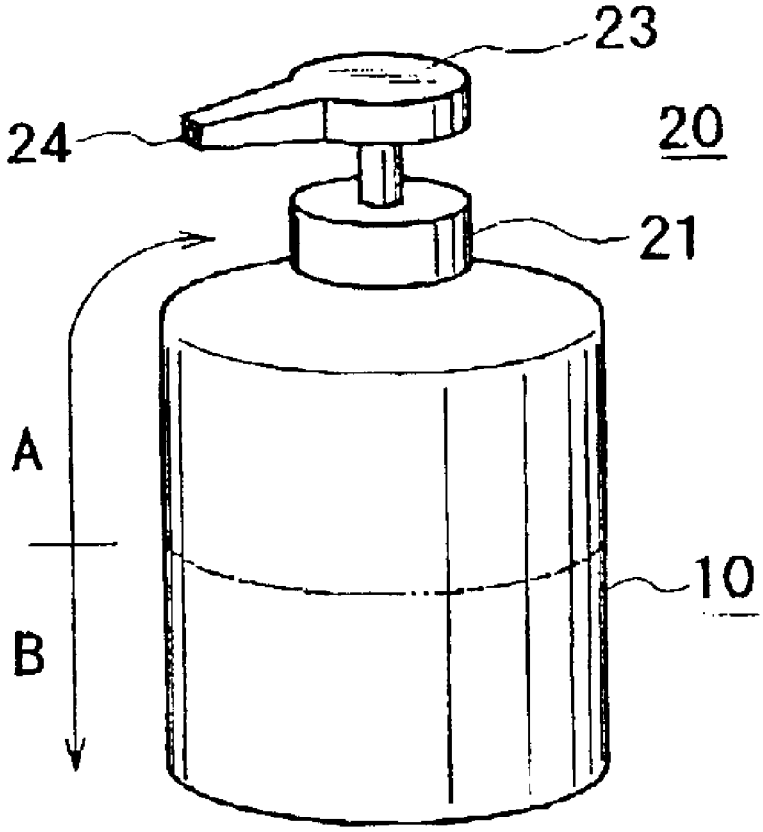
FIG. 1 is a schematic perspective view of the liquid container in the first embodiment of the present invention.
Figure 2:
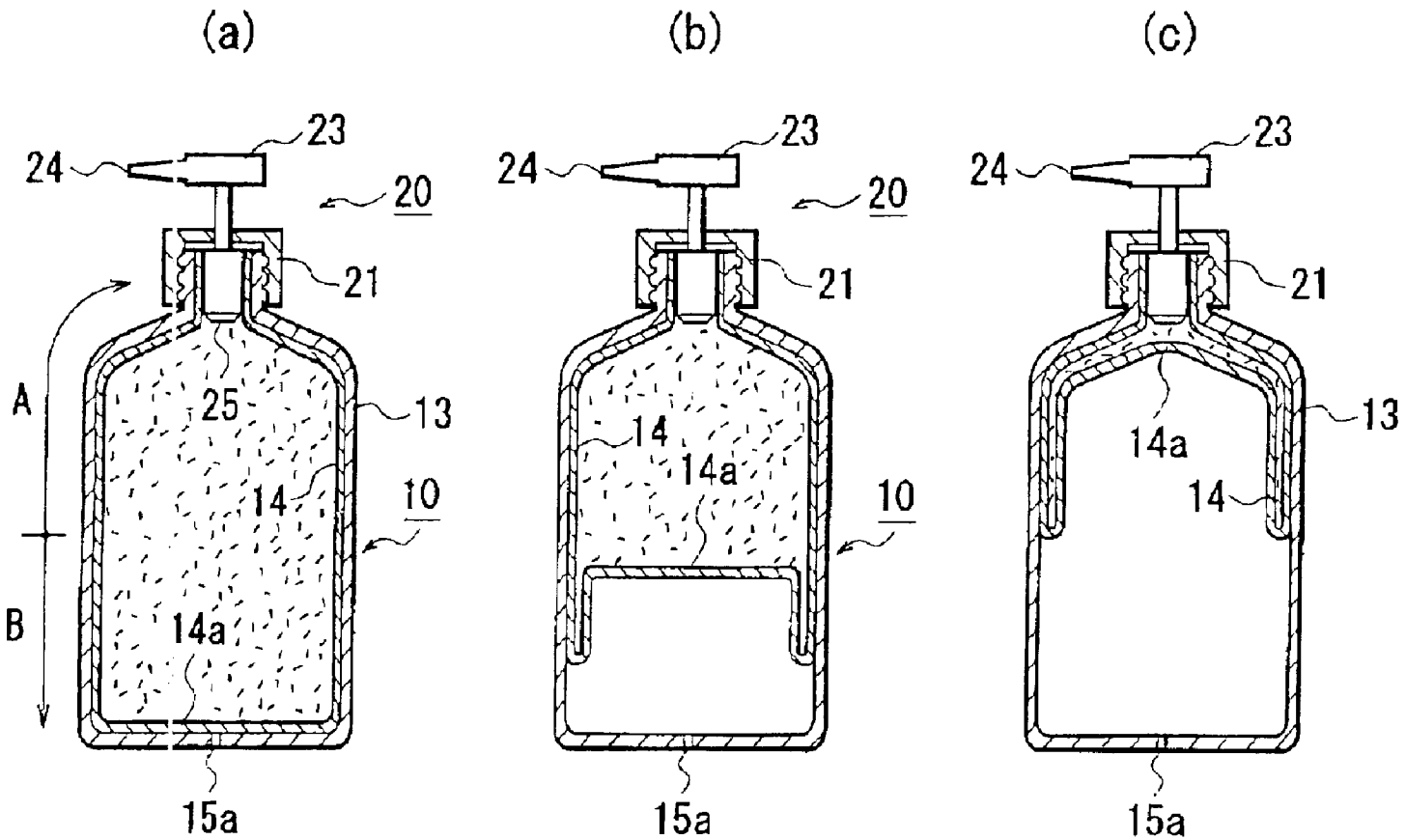
FIG. 2 is a sectional view of the liquid container in FIG. 1, FIGS. 2(*a*), 2(*b*), and 2(*c*) sequentially showing, following the time line, the manner in which liquid is drawn out of the liquid container in FIG. 1.

FIG. 1 is a schematic perspective view of the liquid container in the first embodiment of the present invention. FIGS. 2(*a*)–2(*c*) are sectional views of the liquid container in FIG. 1, sequentially showing, following the time line, the manner in which liquid is drawn out of the container.

The liquid container 10 in this embodiment comprises the container proper, and a liquid extraction pump 20. The container proper comprises an external layer 13, and an internal layer 14. The external layer 13 is rigid, and constitutes the shell portion of the liquid container 10. The internal layer 14 is similar in size to the internal surface of the external layer 13, and makes up the space (liquid storage portion) in which liquid is stored. The extraction pump 20 is attached to the mouth portion of the container proper, and constitutes a liquid discharging mechanism. The extraction pump 20 comprises: a head portion 21, which is in the form of a cylindrical cap, and which is screwed onto the mount portion of the container proper, and a pump portion 23, which has a liquid inlet 25 and a liquid outlet 24. The extraction pump 20 is held to the container proper by the head portion 21, so that the extraction pump 20 extends into the liquid storage portion of the container proper. As the pump portion 23 is pushed into the container proper, the liquid within the liquid storage portion is suctioned into the pump portion 23, and is discharged outward through the liquid outlet 24. The external layer 13 is provided with an air vent 15*a*, through which the ambient air is allowed to enter between the external surface of the internal layer 14 and the internal surface of the external layer 13.

Referring to FIG. 2(*a*), a sectional view, when the liquid container is full of liquid, the external surface of the internal layer 14, and the internal surface of the external layer 13, are entirely in contact with each other, with the presence of adhesive between the two. More specifically, the adhesive applied between the two layers, in Range A, is rendered greater in adhesive strength from the adhesive applied between the two layers, in Range B. Further, in Range B, the adhesive is applied so that the closer to the bottom of the liquid container, the weaker the adhesive strength between the two layers. Further, adhesive is not applied between the two layers, in the range corresponding to the bottom portion of the liquid container 10.

As the liquid within the liquid storage portion begins to be discharged from the liquid container by the extraction pump 20, the internal layer 14 making up the liquid storage portion (space) is forced to collapse inward so that the volume of the liquid storage portion (space) reduces by the amount equal to the volume by which the liquid is discharged In the case of a liquid container, such as the liquid container in this embodiment, which is approximately in the form of a cylinder, as the liquid within the container begins to be discharged, the separation between the internal and external layers of the container is likely to begin within the range corresponding to the side wall of the container. However, the liquid container in this embodiment is structured so that the adhesive strength between the internal and external layers becomes as described above. Thus, as the liquid in the liquid storage portion first begins to be discharged, the portion 14*a* of the internal layer 14, which corresponds to the bottom portion of the liquid container 10, begins to separate from the external layer 13, as shown in FIG. 2(*b*). Then, as the drawing of the liquid from the liquid container 10 continues, the separation between the internal and external layers 14 and 13 gradually progresses from the bottom side (first range), where the adhesive strength is relatively weak, toward the area (second range) where the adhesive strength is relatively greater, while the bottom portion 14*a* of the internal layer 14 is moving toward the mouth of the container while the portion of the internal layer 14 corresponding to the range B becomes completely separated from the portion of the external layer 13 corresponding to the range B. As the liquid is further drawn out of the liquid container 10, the bottom portion 14*a* of the internal layer 14 is moved to the liquid inlet 25 of the pump prober 23, as shown in FIG. 2(*c*), because the force necessary to separate the internal layer 14 from the external layer, in Range A, is greater than the force necessary to collapse the internal layer 13 in such a manner that the bottom portion 14*a* of the internal layer 14 is moved to the liquid inlet 25 of the pump proper 23. In other words, the portion of the internal layer 14, in Range A (where adhesive strength is greater), does not separate from the external layer 13, and as the bottom portion 14*a* of the internal layer 14 reaches the liquid inlet 25 of the pump proper 23, the drawing of the liquid from the liquid container 10 ends, almost completely removing the liquid from the liquid container. During this liquid drawing sequence, comprising the above described phases, the ambient air is drawn into the space formed as the internal layer 14 becomes separated from the external layer 13.

As described above, according to this embodiment of the present invention, the liquid container is designed so that, in Range B, the closer to the bottom of the liquid container, the weaker the adhesive strength between the internal and external layers of the liquid container. Therefore, the liquid container in this embodiment does not suffer from one of the problems which some of the cylindrical ink containers in accordance with the prior art suffer, more specifically, the problem that the path through which liquid is drawn out from the cylindrical liquid container is blocked by the uncontrolled deformation of the internal layer of the ink container. In other words, according to this embodiment of the present invention, it is possible to provide a liquid container capable of delivering the liquid therein more efficiently than a liquid container in accordance with the prior art. Further, according to this embodiment of the present invention, the adhesive strength between the internal and external layer of the liquid container, in Range A, is rendered greater than that in Range B, preventing the portion of the internal layer, in Range A, from separating from the external layer, until the entirety of the portion of the internal layer, in Range B, becomes separated from the external layer. In other words, the liquid container is designed so that it takes a greater amount of force to separate the portion of the internal layer, in the adjacencies of the mouth portion of the ink container, from the external layer than to separate the other portion of the internal layer. Therefore, the internal layer of the liquid container always collapses in the ideal manner. Further, the ink container may be designed so that the adhesive strength between the internal and external layers of the ink container becomes nonuniform even within Range; the adhesive strength between the portion of the internal layer, in Range B, next to the range A, and the external layer, becomes greater than the adhesive strength between the other portion of the internal layer, in Range B, and the external layer. With such a design, it takes a greater amount of force to separate the portion of the internal layer, in Range B, next to the range A, from the external layer. Therefore, the amount of the pressure which must be applied to the pump increases immediately before the liquid container becomes depleted of the liquid within, informing a user that there remains only a small amount of liquid within the liquid container.

At this time, the method for manufacturing the liquid container in this embodiment will be described. One of the methods for manufacturing a multilayer container, the outward surface of the internal layer of which is positioned next to the inward surface of the external layer of the container is the following method which employs blow molding. First, a parison comprising an external layer formed of one type of resin, and an internal layer formed of another type of resin separable from the resin for the external layer, is prepared. The external and internal layers of the parison are made coaxial. This parison is heated and is held sandwiched by the mold, the internal contour of which matches the external contour of the ink container to be manufactured. Then, air is blown into the parison surrounded by the mold to make the parison conform to the internal contour of the ink container mold. Then, the combination of the expanded parison and mold is cooled.

According to the present invention applied for patent, the force necessary to separate a given area of the internal wall of an ink container from the external wall of the ink container can be rendered different from the force necessary to separate another area of the internal wall of the ink container from the external wall of the ink container, by varying the temperature of the former area from that of the latter area while the air is blown into the parison or while the mold is cooled. This can be done because of the following reason. Even when two resins which do not fuse with each other are selected as the materials for the external and internal layers, one for one, to form an ink container, the two resins become slightly adhesive to each other at the interface between the internal and external layers, and adhere therefore to each other as the combination of heat and pressure is applied during the manufacturing of an ink container by blow molding. Further, the adhesive strength between the two layers is affected by the pressure and temperature applied during the molding process. The bottom portion of the internal layer, which is relatively weak in adhesive strength, is separated in advance from the external wall by the application of external force thereto after the completion of the molding process.

The method for adhering the internal and external layers to each other does not need to be limited to the above described one. For example, they may be adhered using such a method that the contents of a two-layer ink container prepared in advance are removed (when contents are air, air is removed) to create a gap between the external and internal layers of the container, and two adhesives varying in strength are applied to the selected areas of the two layers through the air vent, or that rings formed of a resin adherent to both the resin for the external layer and the resin for the internal layer may be concentrically placed between the external and internal layers of the parison, and the two layers are adhered to each other while the parison is blown.

(Embodiment 2)

Figure 3:
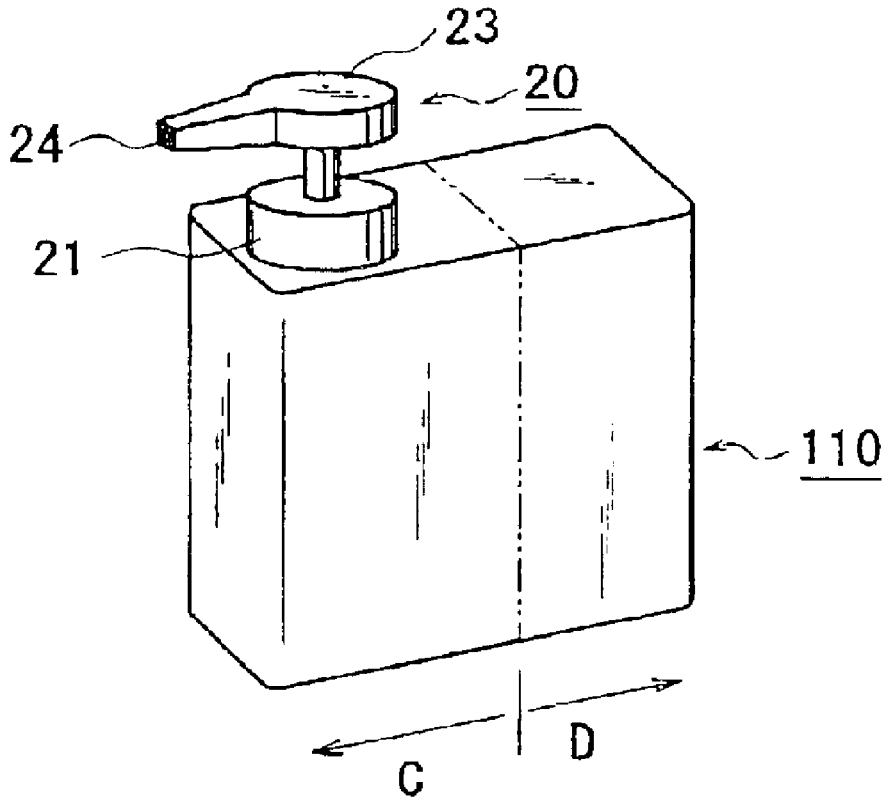
FIG. 3 is a schematic perspective view of the liquid container in the second embodiment of the present invention.
Figure 4:
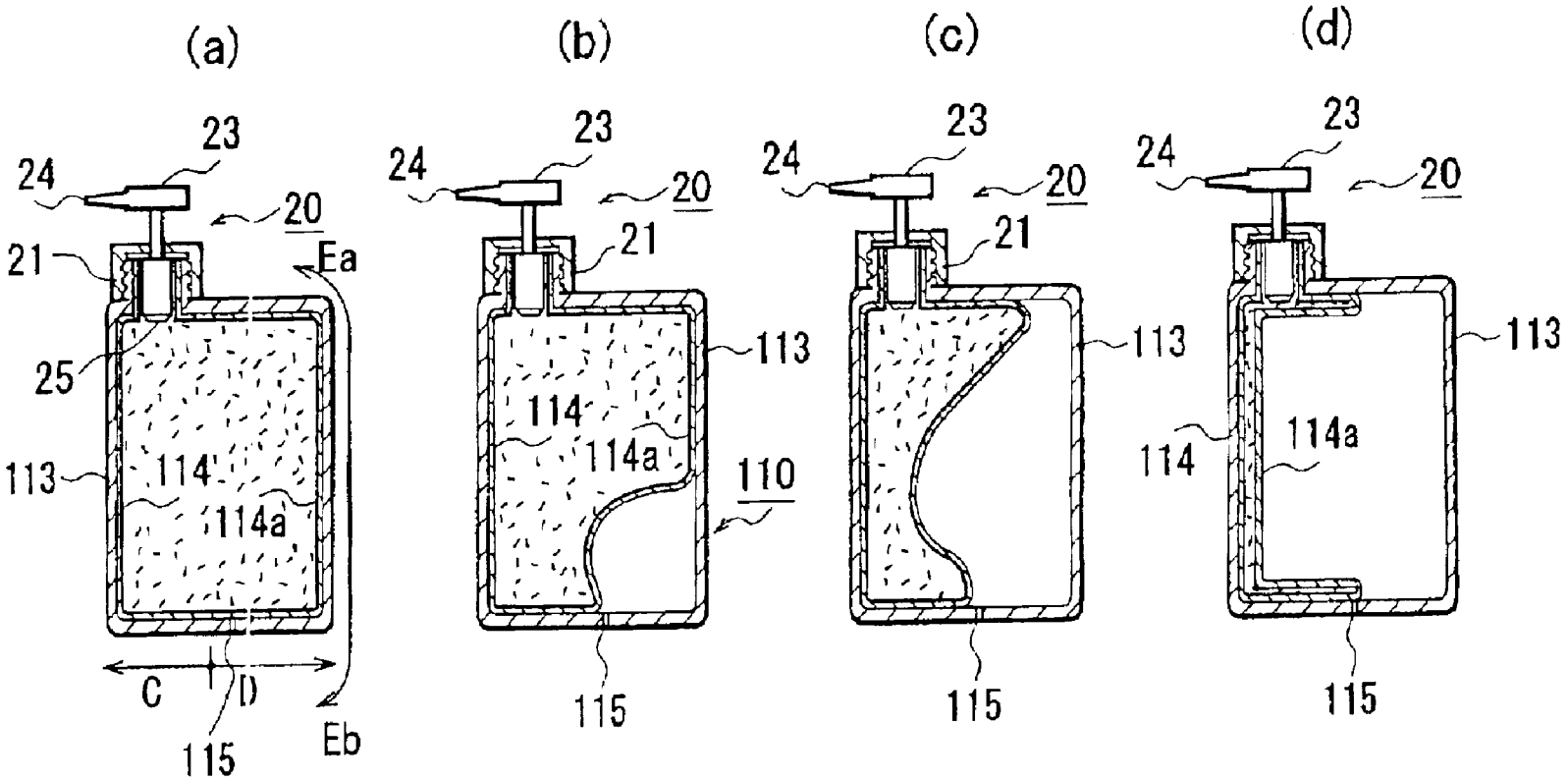
FIG. 4 is a sectional view of the liquid container in FIG. 3, FIGS. 4(*a*), 4(*b*), 4(*c*), and 4(*d*) sequentially showing, following the time line, the manner in which liquid is drawn out of the liquid container in FIG. 3.

FIG. 3 is a schematic perspective view of the liquid container in the second embodiment of the present invention, and FIGS. 4(*a*)–4(*d*) are sectional views of the liquid container in FIG. 3, sequentially showing, following the time line, the manner in which the liquid therein is drawn out of the container.

The liquid container 110 in this embodiment is provided with a liquid discharge pump 20 (liquid extraction pump) as is the liquid container in the first embodiment. However, this embodiment is different from the preceding one in that the container proper is approximately in the form of a rectangular parallelepiped; the adhesive strength between the external and internal layers 114 and 113, in Range C (liquid discharge pump side, as container is horizontally halved; one half with the liquid discharge pump and the other half without it) is greater than that in Range D (side without liquid discharge pump); the closer to the side wall (portion Eb in FIG. 4(*b*)), the weaker the adhesive strength between the internal and external layers 114 and 113, in Range D; and the closer to the top wall (portion Ea in FIG. 4(*a*)), the greater the adhesive strength between the internal and external layers 114 and 113, in Range D.

In this embodiment, as the liquid in the liquid storage portion is discharged by the liquid discharge pump, the internal layer 114 begins to deform from the bottom portion (portion Eb) in Range D, and then, the deformation progresses upward (toward portion Ea) in Range D. Then, the deformation continues in a manner of meticulously folding the internal layer, while no separation occurs between the internal and external layers, in Range C.

As described above, according to the present invention, it is possible to make the internal layer of a liquid container deform at any of various predetermined deformable points and in any order.

(Embodiment 3)

Figure 5:
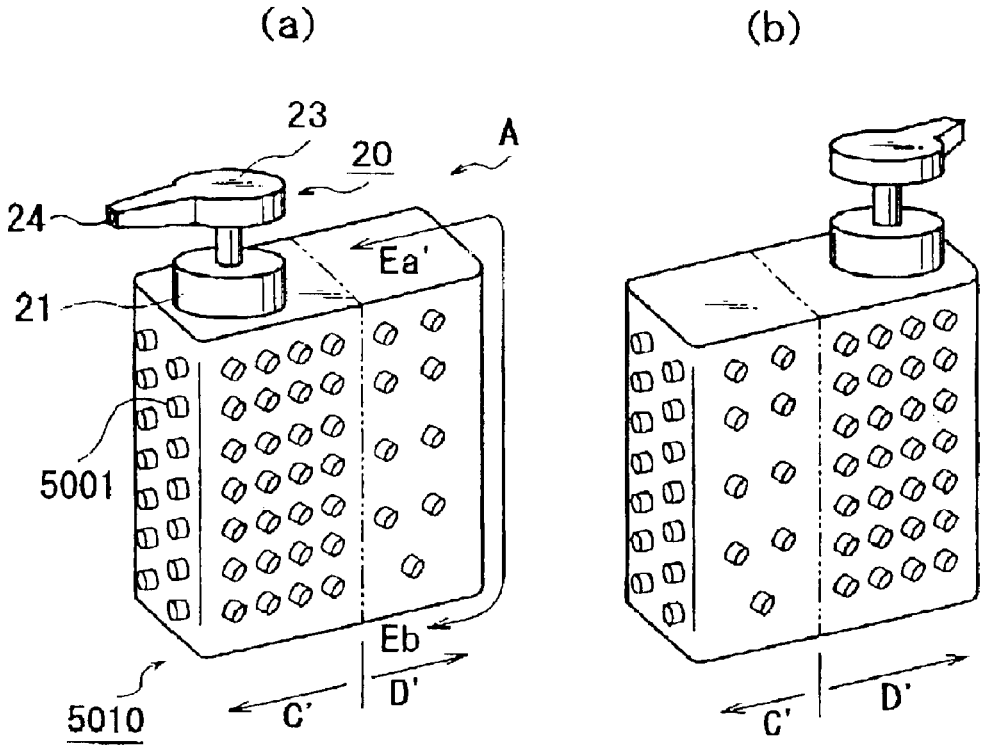
FIGS. 5(*a*) and 5(*b*) are schematic perspective views of the liquid container in the third embodiment of the present invention
Figure 6:
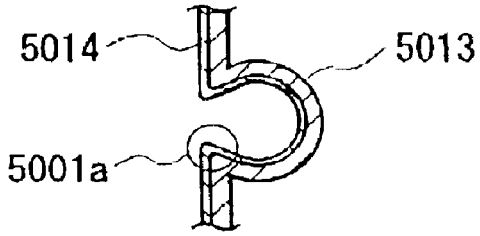
FIG. 6 is an enlarged sectional view of the essential portion of the liquid container in FIG. 5.

FIG. 5 is a schematic drawing for describing the liquid container in the third embodiment of the present invention. FIG. 5(*a*) is a schematic perspective view of the liquid container, and FIG. 5(*b*) is a schematic perspective view of the container as seen from the direction indicated by an arrow mark A in FIG. 5(*a*). This embodiment is different from the first and second embodiments in that the internal layer of the container is kept attached to the external layer of the container with the use of physical means, more specifically, dimples, which will be described later. Otherwise, this embodiment is similar to the above described second embodiment: the shape of the container, exclusive of the dimples, and the structure for drawing the contents out of the container, in this embodiment, are the same as those in the second embodiment. In this embodiment, instead of applying adhesives between the internal and external layers of the container as in the second embodiment, the liquid container is provided with a number of dimples 5001. FIG. 6 is an enlarged sectional view of a part of the container, for describing the dimples 5001. As shown in FIG. 6, the dimple 5001 projects outward of the container from the external layer of the liquid container. In regard to the base portion of the dimple 5001, the dimple 5001, which is rendered narrow by an undercut portion 5001*a*, is hollow, and is connected to the liquid storage proper. As the contents are drawn out of the container, the internal layer 5014 is pulled inward of the container, that is, in the direction to separate the internal layer 5014 from the external layer 5013. However, with the presence of this undercut portion 5001*a*, it takes a greater amount of force to pull the internal layer 5014 out of the dimple 5001 in this embodiment than the force necessary to pull the internal layer 5014 out of a dimple without the undercut portion 5001*a*. This difference between the force necessary to pull the internal layer 5014 out of the dimple 5001 with the undercut portion 5001*a* while separating the internal layer 5014 from the external layer 5013 and the force necessary to pull the internal layer 5014 out of the dimple 5001 without the undercut portion 5001*a* while separating the internal layer 5014 from the external layer 5013, is equivalent to the adhesive force in the above described preceding embodiments. Referring to FIG. 5, in this embodiment, the force keeping the internal layer 5014 attached to the external layer 5013, in Range C', which corresponds to the half of the container comprising the liquid discharge pump, is rendered greater than the force keeping the internal layer 5014 attached to the external layer 5013, in Range D', which is next to the range C' and corresponds to the other half of the liquid container, that is, the half without the liquid discharge pump. Further, in Range D', the closer to the bottom (Eb' in FIG. 5(*a*)) of the liquid container, the smaller the force keeping the internal layer 5014 attached to the external layer 5013; the closer to the top (Ea' in FIG. 5(*a*)), the greater the force keeping the internal layer 5014 attached to the external layer 5013. This difference in the force keeping the internal layer 5014 attached to the external layer 5013 between the ranges C' and D', and between the bottom Eb' and the top Ea' of the liquid container, is created by the difference in the number of the dimples per unit area. In other words, the range C' has a greater number of the dimples per unit area than the range D', and the number of the dimples per unit area is the smallest at the bottom Eb' and gradually increases toward the top Ea'. The order in which the various portions of the internal layer 5014 deform as the liquid is drawn out of the liquid container is the same as that in the above described second embodiment. In other words, a liquid container, which is as great in utility as the liquid container in the preceding embodiments, can be realized with the employment of the physical arrangement in this embodiment instead of the adhesive employed in the preceding embodiments. It should be noted here that when adhesive is employed, the adhesive strength between the internal and external layers might be affected by the environmental factors (temperature, humidity, etc.). In comparison, the physical arrangement such as the one in this embodiment is not likely to be affected by the changes in the environmental factors, being therefore more reliable than adhesive. Further, the liquid container in this embodiment can be easily manufactured simply by providing a set of liquid container molds with portions corresponding to the dimples.

(Embodiment 4)

Figure 7:
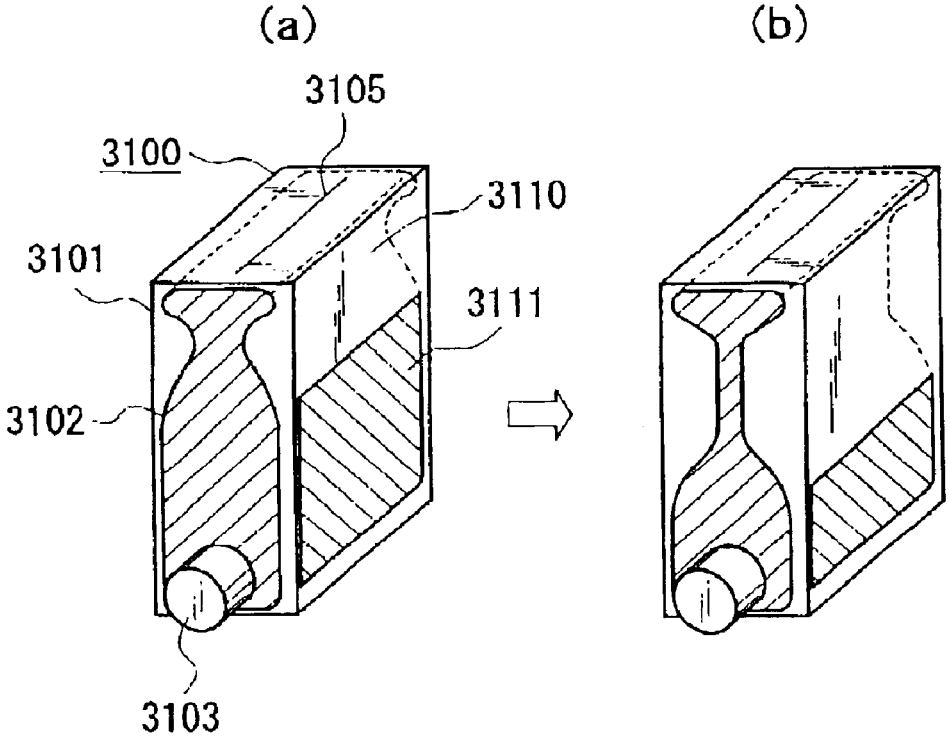
FIGS. 7(*a*) and 7(*b*) are schematic perspective views of the liquid container in the fourth embodiment of the present invention.

FIG. 7 is a schematic perspective view of the liquid container in the fourth embodiment of the present invention. FIG. 7 schematically shows how the liquid containing portion in the liquid container shell deforms. The areas of the liquid container walls, across which the internal and external layers are completely in contact with each other, are shown with hatching. FIG. 7(*a*) represents the state of the liquid container immediately after the liquid begins to be drawn out of the container, and FIG. 7(*b*) represents the state of the liquid container after a half of the liquid in the container has been drawn out. The liquid container in this embodiment is different from those in the preceding embodiments in that the liquid container in this embodiment is structured so that almost the entirety of the internal layer will become separated from the external layer by the time the liquid in the container is entirely drawn out. Referring to FIG. 7, in the case of the liquid container in this embodiment, liquid is stored in the region (liquid storage portion) surrounded by the internal wall 3102, which is separable from the external layer 3101, which constitutes the external shell portion of the liquid container. The external layer 3101 is substantially thicker, as are those in the preceding embodiments, than the internal layer 3102, and hardly deforms even as the internal layer 3102 deforms due to the extraction of the liquid from the container. Further, the external layer 3101 is provided with an air inlet 3105. The portion designated by a referential numeral 3103 is a liquid outlet equivalent to the mouth portions in the preceding embodiments, and is connected to an unshown liquid drawing tube.

Figure 8:
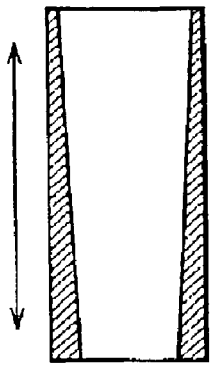
FIG. 8 is a schematic drawing for showing the distribution of adhesive force.

Referring to FIG. 8, in this embodiment, the liquid container is structured so that the adhesive between the internal and external layers of the container walls with the largest area size is strongest at the bottom end, that is, the portion with the liquid outlet, and gradually reduces in strength toward the top surface. Further, the liquid container mold is structured so that the two pinch off portions 3105 of the liquid container, that is, the two portions of the liquid container, at which the parison will be pinched off, will become a part of the top wall of the container and a part of the bottom wall of the container, one for one. Therefore, the top and bottom walls of the liquid container are prevented from deforming by the pinch off portions 3105. Referring to FIG. 7(*a*), which shows the state of the liquid container immediately after the liquid within the liquid container begins to be drawn out of the container, and in which the area 3110, across which the internal layer becomes separated from the external wall, is small in size, the separation of the internal layer from the external layer begins from this area 3110. An more liquid is drawn out, the separation of the internal layer from the external layer progresses into the area 3111, which is immediately adjacent to the area 3110, and in which the internal and external layers are still entirely in contact with each other. In other words, the area 3110 increases in size as the liquid is drawn out of the liquid container. Eventually, almost all of the area 3111 turns into the area 3110, ending the drawing of the liquid from the liquid container. As described above, in this embodiment, the phenomenon that the deformation of the internal layer of a liquid container begins from the area adjacent to the liquid outlet is prevented by structuring the liquid container so that the farther from the liquid outlet, the weaker the adhesive strength between the internal and external layers of the liquid container (the closer to the liquid outlet, the stronger the adhesive strength between the internal and external layers). In other words, this embodiment is also capable of providing a liquid container as high in utility as the liquid containers in accordance with the preceding embodiments.

(Embodiment 5)

Figure 9:
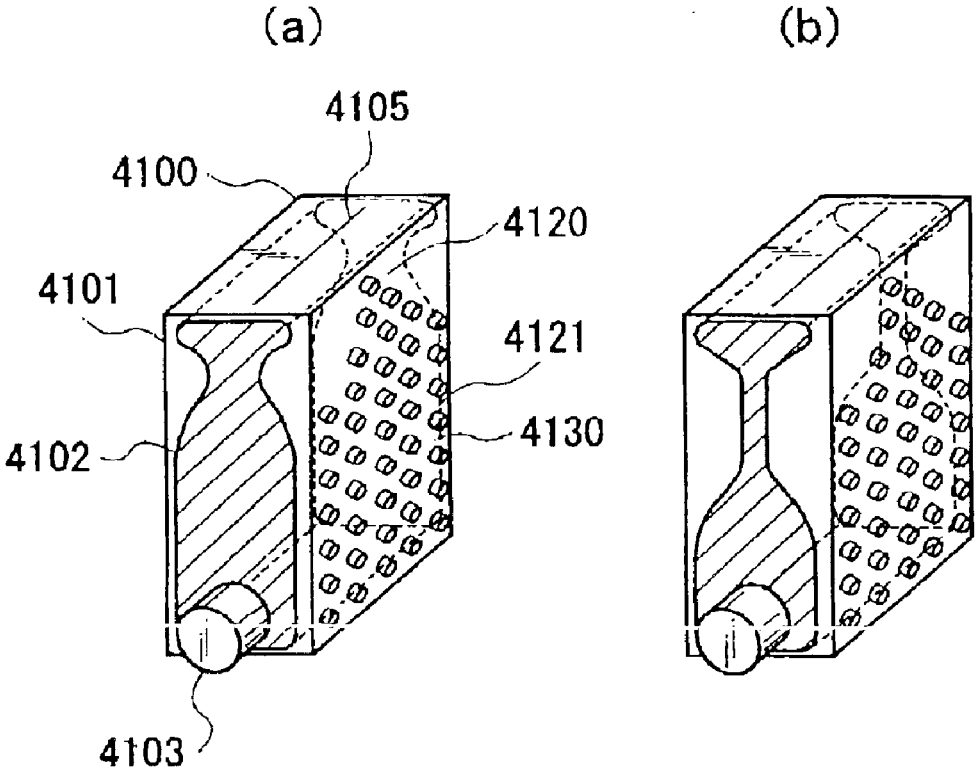
FIGS. 9(*a*) and 9(*b*) are schematic perspective views of the fifth embodiment of the present invention.

FIG. 9 is a schematic perspective view of the liquid container in the fifth embodiment of the present invention. FIG. 9 also schematically shows the manner in which the internal layer, which makes up the liquid storage proper, within the external layer, that is, the external shell, of the liquid container deforms. The hatched area in FIG. 9 represents the portion of the liquid container, across which the internal and external layers of the liquid container are completely in contact with each other. FIG. 9(*a*) represents the state of the liquid container immediately after the liquid begins to be drawn out of the container, and FIG. 9(*b*) represents the state of the liquid container after half of the liquid has been drawn out from the liquid container which was full. The liquid container 4100 in this embodiment is different from the liquid container in the fourth embodiment in that the internal and external layers in this embodiment are kept attached to each other across the area 4121 (which will turn into area 4120 as separation between internal and external layers progresses), by the provision of a plurality of dimples 4130 having an undercut, as they are in the third embodiment. Otherwise, this embodiment is the same as the fourth embodiment: the liquid outlet 4130, internal layer 4102, external layer 4101, and pinch off portion 4105 of the liquid container in this embodiment are the same as those of the liquid container in the fourth embodiment. Therefore, they will not be described.

Also according to this embodiment, it is possible to provide a liquid container as superior in utility as those in the preceding embodiments. There is no limitation to the shape of the dimple 4130, as long as the dimple 4130 is provided with a portion equivalent to the undercut portion; the dimple 4130 may be protruding inward of the liquid storage portion. The amount of the adhesive strength between the internal and external layers may be regulated by changing the dimple height or undercut size, that is, changing the dimple shape, in addition to changing the number of the dimples per unit area.

As described above, according to the present invention, the deformable portions of the internal layer of a liquid container can be gradually and sequentially deformed with the provision of a regulating means which is simple in structure, affording more latitude in setting the order in which the deformable portions of the internal layer of a liquid container are deformed. Therefore, it is possible to provide a liquid container which is superior in utility and which is also reliable.

The regulating means do not need to be limited to the adhesives or dimples described above. Any regulating means will suffice as long as it is the same in function as those described above. It is needless to say that the regulating means may be a physical means, a chemical means, or a combination of various regulating means.

While the invention has been described with reference to the structures disclosed herein, it is not confined to the details set forth, and this application is intended to cover such modifications or changes as may come within the purposes of the improvements or the scope of the following claims.

What is claimed is:

1. A liquid accommodating container comprising:

an inner layer constituting a liquid accommodating portion for accommodating liquid therein;

an outer layer having an inner shape substantially equivalent to an outer shape of said inner layer, said outer layer being provided with an air vent for fluid communication between a space between said inner layer and said outer layer with an ambience;

a liquid supply portion for supplying the liquid out of the liquid accommodating portion, wherein with supply of the liquid through said liquid supply portion, said inner layer peels off said outer layer, wherein said inner layer and said outer layer are in contact, in a first region, with each other with such a force that said inner layer is peelable from said outer layer by change of an inner pressure, and said inner layer and said outer layer are in contact, in a second region, with each other with a force which is larger than that in said first region, by which said inner layer peels off said outer layer in the second region after said inner layer peels off said outer layer in the first region, and wherein said inner layer is bonded to said outer layer with a first bonding force in the first region and a second bonding force in the second region, the second bonding force being larger than the first bonding force.

2. A container according to claim 1, wherein the first region and the second region are provided with outward projections having respective undercut portions, wherein a number of projections in the second region is larger than a number of projections in the first region.

3. A container according to claim 1, wherein first region and the second region are provided with outward projections having respective undercut portions, wherein a degree of projections of the undercut portions in the second region is larger than in the first region.

4. A container according to claim 1, further comprising a third region in addition to the first and second regions, and wherein the inner layer is kept bonded even after the liquid is discharged.

5. A container according to claim 1, wherein a distance from the second region to said liquid supply portion is shorter than a distance from the first region to said liquid supply portion.

* * * * *

UNITED STATES PATENT AND TRADEMARK OFFICE

CERTIFICATE OF CORRECTION

PATENT NO. : 6,945,428 B2
APPLICATION NO. : 10/342284
DATED : September 20, 2005
INVENTOR(S) : Eiichiro Shimizu et al.

It is certified that error appears in the above-identified patent and that said Letters Patent is hereby corrected as shown below:

COLUMN 2:

Line 6, “came” should read --come--.
Line 55, “externa” should read --external--.

COLUMN 5:

Line 5, “diecharged” should read --discharged--.

COLUMN 9:

Line 57, “An” should read --As--.

Signed and Sealed this

Eighteenth Day of July, 2006

JON W. DUDAS
*Director of the United States Patent and Trademark Office*